US007688004B2

(12) United States Patent
Huber

(10) Patent No.: US 7,688,004 B2
(45) Date of Patent: Mar. 30, 2010

(54) DEVICE FOR THE CONTROLLED SWITCHING OF A LAMP, USE OF THE DEVICE AND CORRESPONDING OPERATING METHOD

(75) Inventor: Andreas Huber, Traunreut (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 266 days.

(21) Appl. No.: 11/794,725

(22) PCT Filed: Dec. 20, 2005

(86) PCT No.: PCT/DE2005/002297

§ 371 (c)(1),
(2), (4) Date: Jul. 5, 2007

(87) PCT Pub. No.: WO2006/074630

PCT Pub. Date: Jul. 20, 2006

(65) Prior Publication Data

US 2008/0042581 A1 Feb. 21, 2008

(30) Foreign Application Priority Data

Jan. 13, 2005 (DE) ..... 10 2005 001 767

(51) Int. Cl.
*G05F 1/00* (2006.01)

(52) U.S. Cl. ..... 315/307; 315/291; 315/312; 315/247; 315/224

(58) Field of Classification Search ..... 315/247, 315/226, 224, 225, 291, 297, 307–311
See application file for complete search history.

(56) References Cited

U.S. PATENT DOCUMENTS

2002/0047638 A1 * 4/2002 Allison et al.
2004/0251854 A1 * 12/2004 Matsuda et al. ..... 315/291
2005/0057185 A1 * 3/2005 Tanabe ..... 315/247

FOREIGN PATENT DOCUMENTS

EP 1 204 300 * 5/2002
EP 1 374 366 * 1/2004

* cited by examiner

*Primary Examiner*—Tuyet Vo

(57) ABSTRACT

The invention relates to a device (1) for switching a lamp (2, 3) on and off that is controlled by a digital control input DALI. According to the invention, a load current monitoring is ensured.

7 Claims, 3 Drawing Sheets

DEVICE FOR THE CONTROLLED SWITCHING OF A LAMP, USE OF THE DEVICE AND CORRESPONDING OPERATING METHOD

TECHNICAL FIELD

This invention relates to an apparatus for switching a lamp on and off.

PRIOR ART

Some of the various known lamp types are operated using ballasts and some directly on a battery or mains supply. In particular, transformers and electronic ballasts having converters which match a supply power to an optimum supply for the lamp in terms of the voltage amplitudes and the frequency are suitable as ballasts.

Switching-on and switching-off are effected using conventional switches between the lamp and the power supply or the ballast in the power supply. In individual cases, ballasts can also be controlled, i.e. can be switched on and off via control commands, without a switch between the ballast and the power supply needing to be actuated. Also known are digitally addressable ballasts, i.e. ballasts having a digital control input, via which the operation of the ballast can be controlled using digital signals.

DESCRIPTION OF THE INVENTION

The invention is based on the technical problem of specifying an apparatus for switching lamps on and off which provides improved possibilities for the use of lamps. The invention shall also specify a corresponding use of the apparatus and a corresponding operating method for a lamp.

The invention relates to an apparatus for switching a lamp on and off, having a power supply input and a switched power supply output, the apparatus being designed, in the switched-on state, to output a supply voltage entering at the power supply input, unchanged in terms of amplitude and frequency, to the outside via the power supply output, characterized by a digital control input, in response to which the power supply output is switched, and by a load current monitoring device, which is designed to monitor the load current drawn via the power supply output and to disconnect the power supply output in the event of the load current falling below a minimum load current, as well as to the use of this apparatus for operating a lamp and to a method for operating a lamp using the apparatus, in which the lamp is switched on by the power supply output being switched on in response to a control signal which is input to the digital control input, the load current drawn via the power supply output is monitored by the load current monitoring device, and the lamp is disconnected in the event of the load current falling below a minimum load current by the power supply output being disconnected.

In contrast to the ballasts mentioned at the outset, what is involved here is an apparatus for switching a lamp on and off which, in the switched-on state of the power supply output, passes on the supply voltage entering at its power supply input, substantially unchanged in terms of frequency and amplitude, to the power supply output. It is therefore neither a ballast having converters for generating high-frequency and generally increased voltages for supplying discharge lamps nor a transformer, frequency converter or anything else, but an "extended switch".

According to the invention, this extended switch should be digitally controllable, i.e. have a digital control input, in response to which the power supply output is switched on and off. In addition, a load current monitoring device is integrated in the apparatus in order to ensure that the power supply output does not remain permanently switched on when no lamp is connected or the connected lamp has failed. For this purpose, the load current monitoring device monitors the load current drawn at the power supply output and disconnects the apparatus, i.e. specifically the power supply output and therefore the lamp which may be connected, when the load current falls below a specific minimum load current value. Current monitoring can naturally also take place in the form of power monitoring.

The invention therefore relates to an apparatus which, as a digitally controllable switch for lamps with an integrated load current monitoring device, allows for lamps to be incorporated in a particularly simple manner in digital control systems. These may be digital control systems of relatively large lighting installations having a plurality of lamps and possibly ballasts or other apparatuses according to the invention or else digital building services systems, i.e., for example, driving via a so-called building bus. Lamp types which do not require a ballast, in particular incandescent lamps including halogen incandescent lamps which are operated without a transformer (so-called high-volt halogen lamps), can therefore be incorporated in digital control systems. On the other hand, an advantageous possible application of the invention also consists in incorporating non-digitally controllable ballasts, for example electronic ballasts (EBs) without a digital control input, conventional ballasts (CBs) or electronic transformers without a digital control input and conventional transformers. This therefore in particular relates to discharge lamps, to be precise both in the low-pressure and in the high-pressure sectors, and low-volt halogen incandescent lamps.

The invention therefore obviates in particular the development of digitally controllable ballasts for rarer lamp types which may be used so rarely that it is not worth developing and marketing a digitally controllable ballast. Such lamp types can then be incorporated with ballasts which are provided in any case in relation to the switching-on and switching-off and load current monitoring in a digital control system.

The load current monitoring described preferably also comprises a function of switching the apparatus off in the event of a maximum load current value being exceeded, i.e. determines a permissible load current range outside of which it is disconnected.

In this case, a specific predetermined and optionally also adjustable time is preferably provided which needs to elapse after starting of the lamp, i.e. after a switch-on process in the apparatus, before the load current monitoring actually becomes active. It is thus possible to take account of the fact that specific lamp types have a so-called startup response, i.e. reach their continuous-operation current only after a specific time. The mentioned predetermined time is then possibly selected depending on the lamp type such that this startup time is waited out. In addition, it is possible to take account of the fact that specific ballasts, transformers or series inductors of high-pressure discharge lamps as a result of capacitive or inductive charge currents once the lamp has been switched on entail excessively high currents which may be above the maximum permissible continuous-operation current. The minimum time can apply to the monitoring whether the current exceeds and/or falls below the permissible current values. For further details, reference is made to the exemplary embodiment.

The minimum time can directly follow on from starting of the lamp, i.e. switching-on of the power supply output.

Another possibility consists in first waiting for a specific current threshold value, which does not necessarily need to correspond to the minimum load current, to be exceeded and allowing the predetermined time to run from the time at which the minimum load current is exceeded on. This second possibility is preferably combined with the first possibility. Then, the time running from starting provides protection with regard to the lamp being missing from the outset or with regard to failure of the lamp to ignite. The time provided after the current threshold value has been exceeded in which the minimum load current monitoring likewise remains out of operation and which preferably ends much earlier than the time calculated from starting of the lamp on also ensures that, during actual lamp operation, the corresponding load current monitoring is begun relatively soon. If, for example, the lamp actually ignites correctly, the mentioned current threshold value is reached in a foreseeable time, and then the monitoring can be begun after a relatively short additional time span. If the lamp were to ignite only with difficulties, however, a sufficiently long time should be waited from the actual lamp starting on to see if ignition does in fact still take place.

A further preferred configuration provides, in addition to the described load current monitoring, a short-circuit protection device. This short-circuit protection device differs from the described maximum load current monitoring by virtue of the fact that it becomes active directly after switching-on, i.e. typically in the milliseconds range, while the maximum load current monitoring can become active with a delay in comparison to switching-on nearer to a few seconds or even a few tens of seconds. In addition, the short-circuit protection device has a very much higher current threshold value for it to be triggered, i.e. is not triggered by the mentioned capacitive or inductive charge currents or similar faults at the beginning of operation. The current threshold value is so high that when it is reached it can be assumed that there is a load-side short circuit.

In addition, an overtemperature protection device is preferably provided. This overtemperature protection device monitors the temperature of the apparatus according to the invention, for example via a temperature-dependent resistance at the input of an analog-to-digital converter or the like, and switches the apparatus, i.e. the power supply output, off in the event of a specific maximum permissible temperature value being reached. In this case, reconnection once the temperature has fallen below another or an identical temperature threshold value or else final disconnection can be provided. In addition, a warning signal can be output, in particular via the digital control input, which is then also in the form of an output, i.e. a digital interface.

It has already been mentioned that, in specific cases, increased switch-on currents may occur. These may be disadvantageous with regard to the design of other parts, in particular the design of switches, fuses and line circuit breakers (miniature circuit breakers). A preferred switch-on current limitation according to the invention in this case takes place via an impedance increase, in particular the increase in a nonreactive resistance. Here, a series resistance can be connected in the current path in the initial phase and bridged again later. Another possibility which is also preferred here consists in designing the switch for switching the power supply output electronically and switching it on slowly, i.e. using the internal resistance which is temporarily present in the case of control signals which are becoming correspondingly slow for the electronic switch as the series resistance. In particular, IGBTs or MOSFETs are suitable for this purpose. The electronic switch would therefore operate as a variable resistance during the first milliseconds after a switch-on process, the resistance value of said variable resistance preferably being continuously reduced as time elapses and dropping virtually to zero once the corresponding current peaks have decayed.

A further preferred configuration of the invention provides a signal device in the apparatus, for example an acoustic signal transmitter or an LED. This signal transmitter is intended to be actuated via the digital control input. This makes it possible, when fitting relatively large lighting installations, to address the apparatus according to the invention in a targeted manner and to make it possible for it to be identified via the signal device. If, therefore, a central control device outputs the correct address and the apparatus according to the invention is addressed with the corresponding signal, the fitter knows, owing to the signal from the signal device, that the address used belongs to this individual apparatus. This function is primarily advantageous when lamps are operated which cannot be switched on and off rapidly, with the result that identification by means of the lamp blinking is not applicable, for example in the case of high-pressure discharge lamps. In other cases, it may also be advantageous to design the apparatus according to the invention such that it allows the connected lamp to blink when the corresponding control signal is received in order therefore to result in identification.

BRIEF DESCRIPTION OF THE DRAWINGS

In the text which follows, the invention will be explained in more detail with reference to an exemplary embodiment. Here, disclosed features may also be essential to the invention in other combinations. Moreover, all of the features in the description above and below relate to the apparatus, the use and the method in accordance with the invention, without a distinction explicitly being drawn between them. Specifically.

PREFERRED EMBODIMENT OF THE INVENTION

Figure 1:
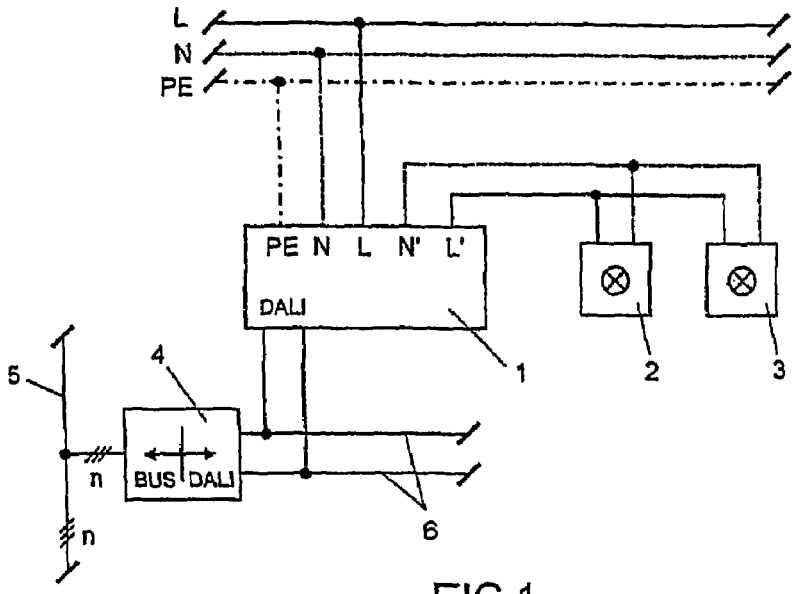
FIG. 1 shows a block circuit diagram of an apparatus according to the invention with a mains connection, control connection and two connected lamps.

FIG. 1 shows an apparatus according to the invention which is illustrated here merely as block 1 and is connected to a mains supply via a protective ground conductor PE, a neutral conductor N and a phase conductor L. The terminals PE, N and L of the apparatus 1 form a power supply input.

Further terminals N' and L' of the apparatus 1 form a power supply output, to which two loads 2 and 3 are connected. These loads may be, for example, energy-saving lamps with a non-digitally drivable ballast or incandescent lamps.

Figure 2:
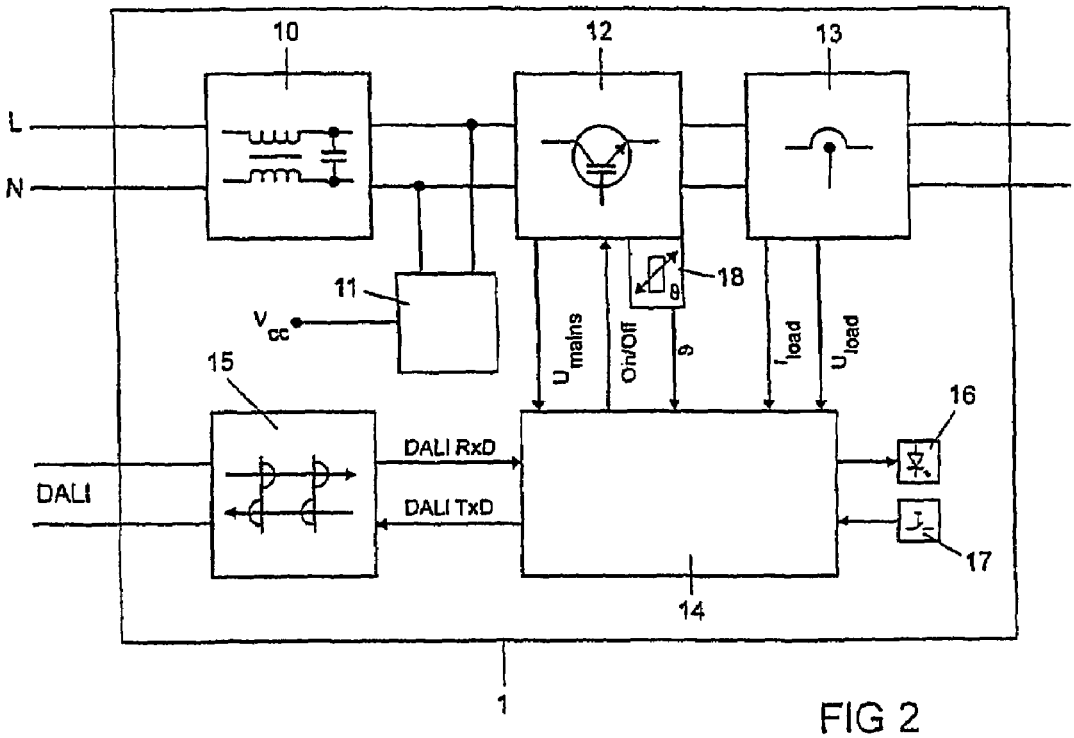
FIG. 2 shows a block circuit diagram of the internal construction of the apparatus shown in FIG. 1.

As is illustrated more clearly in FIG. 2, the power supply output N', L' is switched. The switching function takes place in response to a digital control input, which is denoted by the reference symbol DALI. This represents an industry standard of a digital protocol in lighting engineering (Digital Addressable Lighting Interface). The digital control input DALI is driven by a gateway 4, which converts the DALI protocol bidirectionally into a different protocol of a building bus system. The building bus system is indicated by the lines drawn on the left-hand side in FIG. 1 and denoted by 5. The building bus system 5 is abbreviated to BUS and can also control and monitor other building functions in addition to a digital lighting installation. In particular, numerous other gateways of lighting devices or other technical devices of the building are connected to the building bus system, as is indicated by the obliques and the letter "n". The lines 6 continuing straight to the right of the gateway 4 lead to further DALI components, for example DALI-controllable EBs of discharge lamps.

In this case, driving of the apparatus 1 according to the invention therefore takes place directly from the building bus system. If there are further gateways 4 connected, the lighting installation is one which is controlled centrally by the building bus system. Alternatively, there may also be a central DALI controller, which could optionally be connected centrally to the building bus system 5.

If, therefore, the building bus system 5 outputs a corresponding command to the digital control input DALI via the gateway 4, the apparatus 1 connects the power supply output N', L' to the input N, L or disconnects it therefrom. Enquires regarding the switching state and the load state are also possible via this signal path.

FIG. 2 shows the apparatus shown in FIG. 1 with a schematic illustration of its internal construction. At the top left, the power supply input is illustrated by N and L, the protective ground PE being omitted. The first block 10 denotes a mains filter known per se with capacitive and inductive elements for filtering out interference components in the mains supply. From the filtered supply lines there are taps to a block 11, which discharges an internal supply voltage $V_{CC}$ for the apparatus 1. 12 denotes an electronic switch in the supply lines which is connected to the power supply output L', N' via a current-sensing element 13. The current-sensing element 13 may be, for example, a so-called shunt resistor or a measuring transformer.

The switch 12 is actuated via a signal line denoted by "On/Off" by a microcontroller 14 with a program and data store. The microcontroller 14 senses the instantaneous mains voltage at the switch 12 via the line denoted by $U_{mains}$ and the instantaneous load current and the instantaneous load voltage via the lines denoted by $I_{load}$ and $U_{load}$, on the output side of the switch 12.

The microcontroller 14 is controlled by the digital control input DALI (bottom left in FIG. 2) via a line denoted by DALI RxD (Receive Data) via a DALI interface 15 and returns feedback signals via the line DALI TxD (Transmit Data) via the interface 15.

In addition, the microcontroller 14 causes an identification LED 16 to blink in response to DALI commands in order to make it possible to identify the apparatus 1.

Referencing of the apparatus 1 to a connected lamp with or without a ballast can be carried out manually via a referencing button 17, as will be explained in more detail with reference to FIG. 3.

Overall, the apparatus 1 can be controlled in terms of the switching function of the electronic switch 12 via the control input DALI, the interface 15 and the microcontroller 14, so that the lamp connected to the power supply output L', N' is connected to the (filtered) mains supply L, N or disconnected from it. During fitting, the LED 16 can be caused to blink via a corresponding control command in order to carry out an assignment to the control address. Once a lamp with or without a ballast has been connected to the power supply output L', N', referencing, as explained below, is possible via the referencing button 17.

The microcontroller 14 also receives a signal of a temperature-dependent resistance 18, which has been converted into a digital signal via an analog-to-digital converter. The overtemperature protection already described can therefore be ensured.

Once a temperature limit value has been exceeded, the microcontroller 14 switches the load off automatically and switches it on again with a hysteresis of a few degrees Celsius once the temperature has fallen below the temperature trigger value. The overtemperature protection is primarily critical for protection of the electronic switch 12, so that the temperature-sensitive resistance is arranged with a physical proximity to it.

Figure 3:
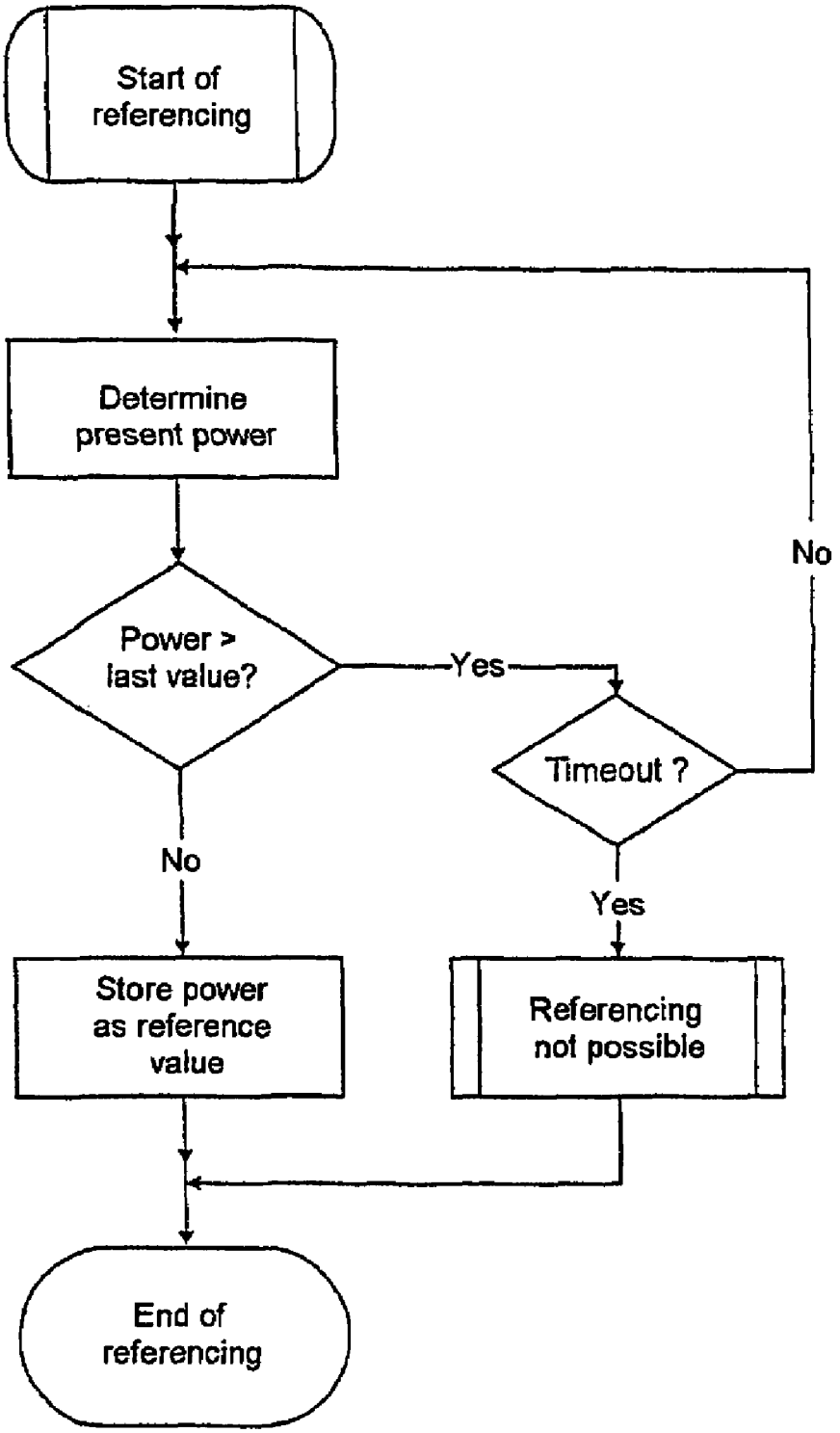
FIG. 3 shows a schematic flow chart for the sequence of referencing for the apparatus shown in FIGS. 1 and 2.

FIG. 3 shows this referencing in the form of a schematic block diagram. The sequence begins at the top with starting of the referencing and following determination of the present power. For this purpose, the connected lamp is therefore brought into operation, i.e. the switch 12 is closed, and an active power is determined via the current-sensing device with the values $U_{load}$ and $I_{load}$. For this purpose, either the time of the amplitude maximum of $U_{load}$ can be determined by the microcontroller by means of a suitable measurement and the current $I_{load}$ measured at this time, which current is then a measure of the active current and therefore the active power, or the microcontroller determines the phase shift between $U_{load}$ and $I_{load}$ and the measured values for $U_{load}$ and $I_{load}$ and calculates the active power therefrom. The technical details of an active power determination are incidentally known to a person skilled in the art and therefore do not need to be given in any more detail here.

If the instantaneous active power, i.e. the power output via the power supply output L', N', is greater than the last determined active power value, a safety time enquiry (time out?) takes place and a return loop to the new power determination is performed before the maximum time has elapsed.

If the power no longer continues to increase, i.e. is no longer greater than the last value, the power is stored as a reference value, so that the referencing is concluded. In this form, by connecting a new and functional lamp with or without a ballast its actually measured continuous-operation power is therefore stored as a reference value. If, owing to the mentioned maximum time interval (time out), no referencing should arise, a fault signal occurs, since in this case correct lamp operation has not taken place.

Figure 4:
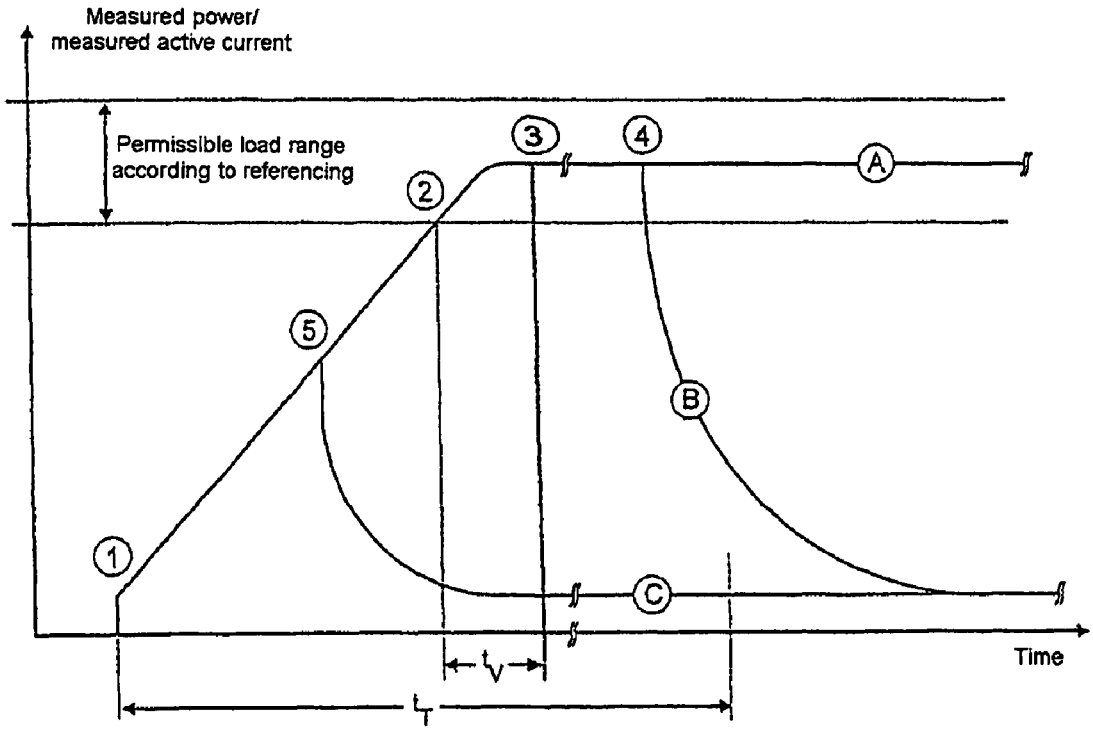
FIG. 4 shows a time profile graph for explaining the lamp operation startup with the apparatus shown in FIGS. 1 and 2.

FIG. 4 shows, in the form of a time profile graph, typical lamp starting with the apparatus shown in FIG. 1 using the example of a high-pressure discharge lamp with a conventional series inductor. The y axis shows the measured power or, with the same significance here, the measured active current, while the x axis illustrates the time. The referencing explained with reference to FIG. 3 results, together with predetermined tolerance deviations to lower and higher values, in a permissible load range, which is illustrated at the top in FIG. 4 by two dashed lines parallel to the x axis.

The ignition process takes place at the circled number "1", whereupon the lamp power and the lamp current increase slowly with time. This is the typical startup response of a high-pressure discharge lamp, which is illustrated here in simplified form. At this time "1", a first predetermined time $t_T$, which can be adjusted depending on the lamp type, is started.

In one conceivable case, the lamp fails at the time denoted by "5". Once the time $t_T$ has elapsed, a check is carried out by the microcontroller 14 to ascertain whether the measured value $I_{load}$ is within the permissible load range, which here, in the case C, is obviously not the case. Once the time $t_T$ has elapsed, a fault message therefore takes place, i.e. the output of a digital alarm signal from the microcontroller 14 via the line DALI TxD, the interface 15 and the control input, which at the same time represents a signal output.

In other cases, a normal startup operation of the lamp takes place, with the result that, at time "2", a power or current threshold value, namely in this case the lower limit of the permissible load range, is exceeded. At this time, a second adjustable and predetermined time $t_V$ is started which elapses much earlier than the previously mentioned time $t_T$. When this time $t_V$ elapses, namely at time "3", the microcontroller 14 checks whether the actually measured value $I_{load}$ is in the permissible load range, which is the case here (apart from the case C, which has just been discussed). The lamp therefore remains switched on.

If, after a certain time, at time "4", which is still before the time $t_T$ elapses, the lamp fails (case B), the lamp current or the lamp power falls and the abovementioned check once the time $t_T$ has elapsed results in a value outside the permissible load range and therefore in the lamp being switched off, as has already been described for the case C.

In a further case A, the lamp continues to function, with the result that, once the time $t_T$ has elapsed, no switch-off process takes place as a result of the monitoring. If, over the further course of time, the lamp were to fail, temporally regular enquiries by the microcontroller 14 would detect this and would in turn lead to the lamp being switched off and an alarm signal. These enquiries take place at short time intervals and therefore, in terms of the lamp operation, virtually continuously, to be precise starting when the time $t_T$ elapses.

Both times $t_T$ and $t_V$ can be programmed and therefore matched to the connected lamp or the connected ballast with the lamp. This can take place firstly via corresponding DALI commands or secondly via adjustment possibilities on the apparatus 1 itself which are not illustrated here.

The invention claimed is:

1. An apparatus for switching a lamp on and off, having a power supply input and a switched power supply output, the apparatus being designed, in the switched-on state, to output a supply voltage entering at the power supply input, unchanged in terms of amplitude and frequency, to the outside via the power supply output, characterized by a digital control input, in response to which the power supply output is switched, and by a load current monitoring device, which is designed to monitor the load current drawn via the power supply output and to disconnect the power supply output in the event of the load current falling below a minimum load current, in which the load current monitoring device only begins to monitor the load current once a predetermined time ($t_T$, $t_V$) has elapsed after the lamp has been switched on.

2. The apparatus as claimed in claim 1, in which the predetermined time ($t_V$) begins with a current threshold value being exceeded after starting of the lamp.

3. The apparatus as claimed in claim 1, in which the predetermined time ($t_T$) begins with starting of the lamp.

4. The apparatus as claimed in claim 3, in which the predetermined time ($t_V$) begins with a current threshold value being exceeded after starting of the lamp.

5. An apparatus for switching a lamp on and off, having a power supply input and a switched power supply output, the apparatus being designed, in the switched-on state, to output a supply voltage entering at the power supply input, unchanged in terms of amplitude and frequency, to the outside via the power supply output, characterized by a digital control input, in response to which the power supply output is switched, and by a load current monitoring device, which is designed to monitor the load current drawn via the power supply output and to disconnect the power supply output in the event of the load current falling below a minimum load current, and having a switch-on current limiting device which is designed to limit the load current drawn once the lamp has been switched on by an impedance increase in the apparatus.

6. The apparatus as claimed in claim 5, having an electronic switch for switching the power supply output, in which the switch-on current limiting device is designed to slowly switch the electronic switch on in order to limit the load current drawn by the connected lamp by the increased internal resistance of the electronic switch during the switch-on process.

7. An apparatus for switching a lamp on and off, having a power supply input and a switched power supply output, the apparatus being designed, in the switched-on state, to output a supply voltage entering at the power supply input, unchanged in terms of amplitude and frequency, to the outside via the power supply output, characterized by a digital control input, in response to which the power supply output is switched, and by a load current monitoring device, which is designed to monitor the load current drawn via the power supply output and to disconnect the power supply output in the event of the load current falling below a minimum load current, in which the load current monitoring device is also designed, when monitoring the load current drawn via the power supply output, to disconnect the apparatus in the event of a maximum load current being exceeded, and in which the load current monitoring device only begins to monitor the load current once a predetermined time ($t_T$, $t_V$) has elapsed after the lamp has been switched on.

* * * * *